US011567441B2

(12) United States Patent
Itoh

(10) Patent No.: US 11,567,441 B2
(45) Date of Patent: Jan. 31, 2023

(54) IMAGE FORMING APPARATUS DISPLAYING ABNORMAL STATE OF ROTARY MEMBERS DRIVEN BY A MOTOR BASED ON A DETECTED CURRENT VALUE

(71) Applicant: CANON KABUSHIKI KAISHA, Tokyo (JP)

(72) Inventor: Masatoshi Itoh, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/523,596

(22) Filed: Nov. 10, 2021

(65) Prior Publication Data

US 2022/0171317 A1 Jun. 2, 2022

(30) Foreign Application Priority Data

Nov. 30, 2020 (JP) ..... JP2020-198380
Jul. 21, 2021 (JP) ..... JP2021-120719

(51) Int. Cl.
*G03G 15/00* (2006.01)
*G03G 15/08* (2006.01)
*G03G 21/16* (2006.01)

(52) U.S. Cl.
CPC ..... *G03G 15/55* (2013.01); *G03G 15/0808* (2013.01); *G03G 15/502* (2013.01); *G03G 21/1647* (2013.01); *G03G 2221/1657* (2013.01)

(58) Field of Classification Search
CPC ..... G03G 15/0808; G03G 15/5016; G03G 15/502; G03G 15/55; G03G 15/80; G03G 21/1647; G03G 2221/1657; G03G 15/0896; G03G 21/1676
See application file for complete search history.

(56) References Cited

U.S. PATENT DOCUMENTS

| | | | | |
|---|---|---|---|---|
| 9,823,617 | B2 | 11/2017 | Shimura | |
| 10,069,435 | B2 | 9/2018 | Itoh | |
| 10,303,091 | B2 | 5/2019 | Isomi | |
| 2015/0145454 | A1* | 5/2015 | Kameyama | G03G 15/5008 318/400.34 |
| 2019/0033771 | A1* | 1/2019 | Sakai | G03G 15/80 |
| 2020/0338916 | A1* | 10/2020 | Itoh | B41J 29/38 |
| 2021/0373478 | A1* | 12/2021 | Itoh | G03G 21/1647 |

FOREIGN PATENT DOCUMENTS

| | | |
|---|---|---|
| JP | 2001-209276 A | 8/2001 |
| JP | 2007-187953 A | 7/2007 |
| JP | 2008-107523 A | 5/2008 |
| JP | 2014-084209 A | 5/2014 |

* cited by examiner

*Primary Examiner* — Sophia S Chen
(74) *Attorney, Agent, or Firm* — Venable LLP

(57) ABSTRACT

An image forming apparatus includes at least one or more rotary members, a motor configured to drive the at least one or more rotary members, a detection unit configured to detect a current value flowing in the motor, and a display unit configured to display information on a state of the at least one or more rotary members. The current value is detected by the detection unit while the at least one or more rotary members are being driven by the motor. When the current value is a first value, information indicating that the at least one or more rotary members are in an abnormal state is not displayed on the display unit. When the current value is a second value larger than the first value, information indicating that the at least one or more rotary members are in the abnormal state is displayed on the display unit.

19 Claims, 11 Drawing Sheets

| FIG. 6A |
| --- |
| FIG. 6B |

| |
|---|
| FIG.8A |
| FIG.8B |
| FIG.8C |

IMAGE FORMING APPARATUS DISPLAYING ABNORMAL STATE OF ROTARY MEMBERS DRIVEN BY A MOTOR BASED ON A DETECTED CURRENT VALUE

BACKGROUND OF THE INVENTION

Field of the Invention

The present invention relates to an image forming apparatus including a brushless motor, for example, a copying machine, a printer, or a facsimile device.

Description of the Related Art

A brushless motor is used as a driving source of a rotating member of an image forming apparatus. Among brushless motors, a construction configured to detect an operating current of the motor and limit the operating current has been proposed (Japanese Patent Application Laid-Open No. 2001-209276). In recent years, a space given to the brushless motor has become smaller than before due to a miniaturization of a product of the image forming apparatus, and it is required to miniaturize the motor while securing a necessary output. Therefore, it has been proposed to realize the miniaturization of the motor by designing the motor so as not to have a large margin for a required output. When an unexpected overload occurs, it is proposed to stop the motor by setting a limit on the current value to prevent motor failure due to overheating, etc.

However, a state of a plurality of rollers changes. Even if the state of the plurality of rollers changes, it is required to drive the plurality of rollers by one motor.

SUMMARY OF THE INVENTION

According to an embodiment, an image forming apparatus comprises:

at least one or more rotary members;

a motor configured to drive the at least one or more rotary members;

a detection unit configured to detect a current value flowing in the motor; and a display unit configured to display information about a state of the at least one or more rotary members, wherein the current value is detected by the detection unit in a state in which the at least one or more rotary members are driven by the motor, and in a case in which the current value is a first value, information indicating that the at least one or more rotary members are in an abnormal state is not displayed on the display unit, and in a case in which the current value is a second value larger than the first value, information indicating that the at least one or more rotary members are in the abnormal state is displayed on the display unit.

Further features of the present invention will become apparent from the following description of exemplary embodiments with reference to the attached drawings.

DESCRIPTION OF THE EMBODIMENTS

Hereinafter, an exemplary embodiment of the present invention will be described in detail with reference to the drawings.

First Embodiment

[Image Forming Apparatus]

Figure 1:
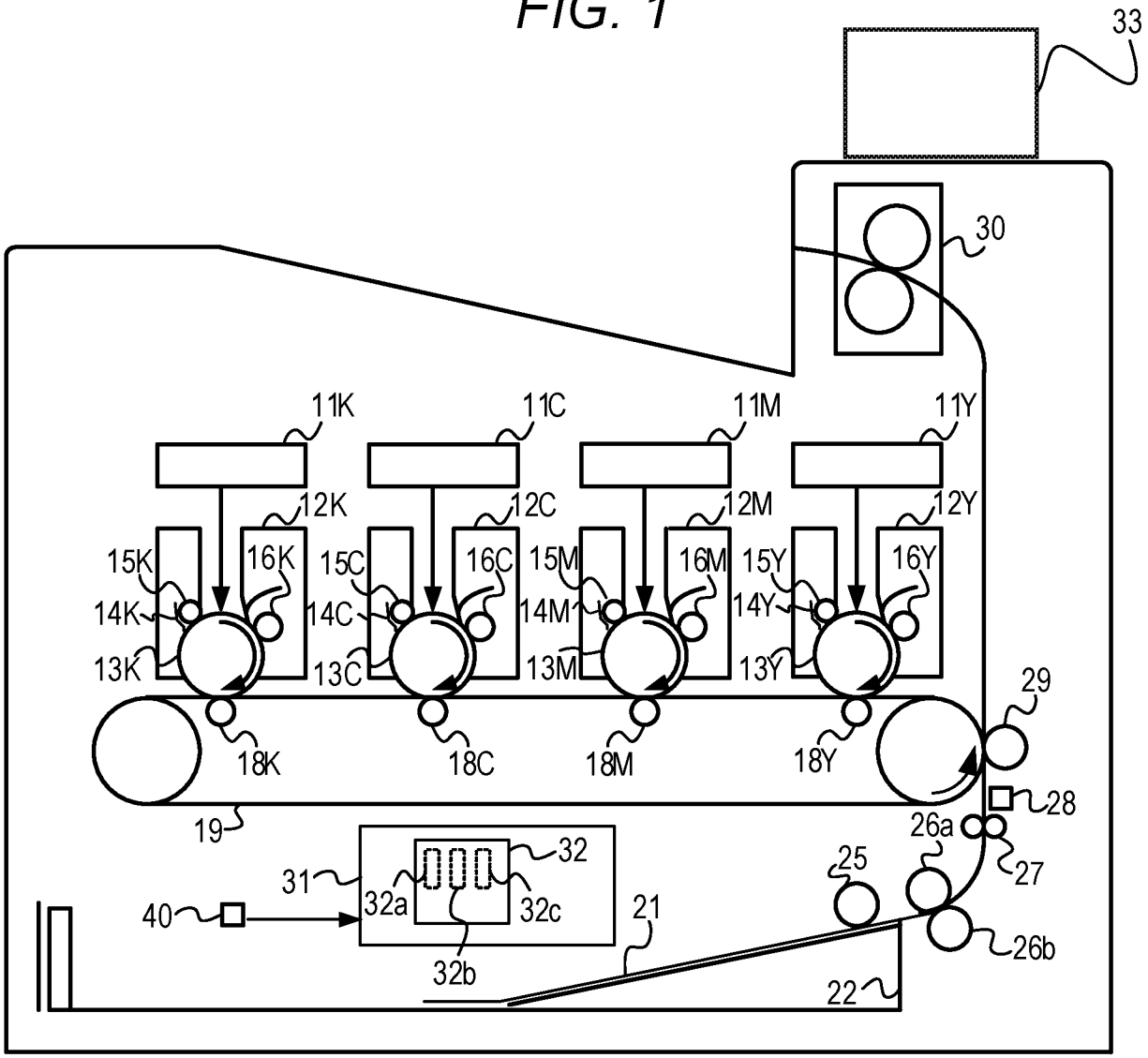
FIG. 1 is a schematic cross-sectional view of an image forming apparatus of a first and second embodiments.

Hereinafter, a first embodiment 1 will now be described with reference to FIGS. 1, 2, 3, 4A, 4B, 5A and 5B. However, the first embodiment is merely an example, and the invention is not limited to these configurations. FIG. 1 is a view of an image forming apparatus such as a tandem color laser printer using an electrophotographic process. Referring to FIG. 1, an image forming operation will be described with respect to a configuration of the image forming apparatus. The tandem color image forming apparatus is configured to output a full color image by superimposing toner images of four colors of yellow (Y), magenta (M), cyan (C) and black (K). And in order to perform respective color image formations, laser scanners 11Y, 11M, 11C, 11K and cartridges 12Y, 12M, 12C, 12K are provided. The subscripts Y, M, C, and K of the symbols will be omitted below, except for a description of a member related to a specific color.

The cartridge 12 includes a photosensitive drum 13 rotating in a direction indicated by an arrow (clockwise direction) in FIG. 1, a photosensitive drum cleaner 14 provided in contact with the photosensitive drum 13, a charging roller 15, and a developing device having a developing roller 16. Further, an intermediate transfer belt 19 is provided in contact with the photosensitive drums 13 of respective colors, and primary transfer rollers 18 are provided opposite to the photosensitive drums 13 so that the intermediate transfer belt 19 is sandwiched between the primary transfer rollers 18 and the photosensitive drums 13.

Figure 2:
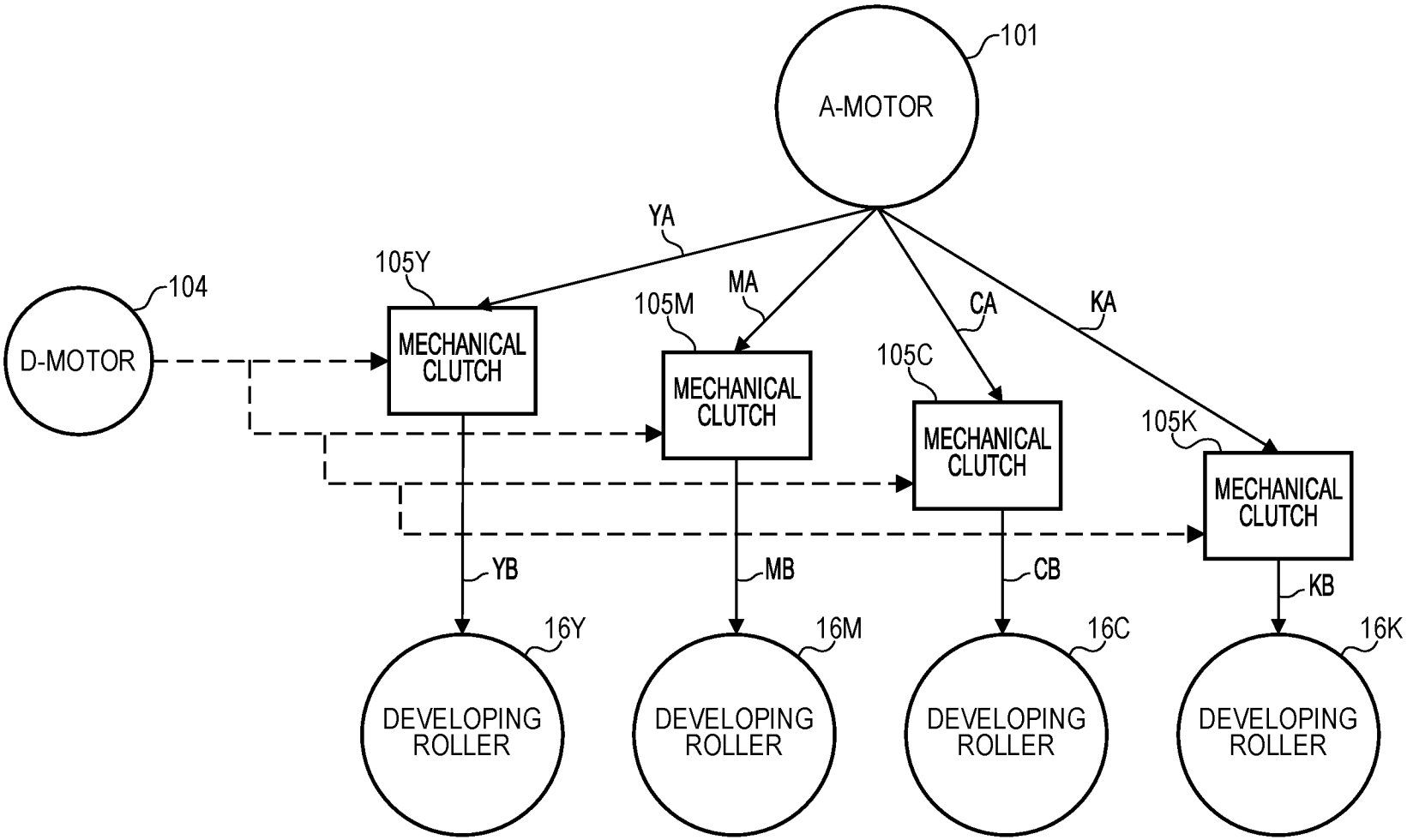
FIG. 2 shows a driving configuration of an A-motor of the first and second embodiments.

The image forming apparatus includes an A-motor 101 (motor), which will be described later with reference to FIG. 2, configured to rotate one or more developing rollers 16. The image forming apparatus includes a B-motor (not shown) configured to rotate the photosensitive drums 13Y, 13M, and 13C, and a C-motor (not shown) configured to rotate the intermediate transfer belt 19 and the photosensitive drum 13K. The A-motor 101, the B-motor and the C-motor are DC brushless motors. Which motor rotates each roller is not limited to the first embodiment.

A feed roller 25, separation rollers 26*a* and 26*b*, and a registration roller 27 are provided on a downstream side in a conveyance direction of a cassette 22 configured to store a sheet 21. A conveyance sensor 28 is provided near the downstream side in the conveyance direction of the registration roller 27. Further, on a downstream side of a conveyance path, a secondary transfer roller 29 is disposed in contact with the intermediate transfer belt 19, and a fixing device 30 is disposed on the downstream side of the secondary transfer roller 29. A printer controller 31 is a controller of the image forming apparatus and comprises a CPU (central processing unit) 32 including a ROM 32*a*, a RAM 32*b*, and a timer 32*c*, and various input/output control circuits (not shown). A display panel 33 as a display unit displays a screen according to a signal from the CPU 32.

Next, the electrophotographic process will be briefly described. In a dark place in the cartridge 12, the charging roller 15 uniformly charges a surface of the photosensitive drum 13. The photosensitive drums 13Y, 13M, and 13C are configured to be rotated by a driving force of the B-motor being transmitted by a gear. Similarly, the photosensitive drum 13K and the intermediate transfer belt 19 are configured to be rotated by a driving force of the C-motor being transmitted by a gear.

Next, the surface of the photosensitive drum 13 is irradiated with a laser light modulated according to an image data by the laser scanner 11, and the charged charge in a portion irradiated with the laser light is eliminated, whereby an electrostatic latent image is formed on the surface of the photosensitive drum 13. In the developing device, toner from the developing roller 16 holding a fixed amount of toner layer is adhered to the electrostatic latent image on the photosensitive drum 13 by a developing voltage, so that a toner image of each color is formed on the surface of the photosensitive drum 13.

The toner image formed on the surface of the photosensitive drum 13 is attracted to the intermediate transfer belt 19 by a primary transfer voltage applied to the primary transfer roller 18 at a nip between the photosensitive drum 13 and the intermediate transfer belt 19. Further, the CPU 32 controls an image forming timing in each cartridge 12 by a timing corresponding to a conveyance speed of the intermediate transfer belt 19, and sequentially transfers the respective toner images onto the intermediate transfer belt 19. Thus, a full color image is finally formed on the intermediate transfer belt 19.

On the other hand, the sheet 21 in the cassette 22 is conveyed by the feed roller 25 onto the conveyance path, and one sheet 21 separated by the separation rollers 26*a* and 26*b* passes through the registration roller 27 and is conveyed to the secondary transfer roller 29. Thereafter, the toner image on the intermediate transfer belt 19 is transferred to the sheet 21 at a nip portion between the secondary transfer roller 29 and the intermediate transfer belt 19 on the downstream side of the registration roller 27 so that an unfixed toner image is formed on the sheet 21. Finally, the unfixed toner image on the sheet 21 is heat-fixed by the fixing device 30 and the sheet 21 to which the toner image is fixed is discharged to an outside of the image forming apparatus. The image forming apparatus includes, for example, an environmental temperature sensor 40 configured to measure an environmental temperature of outside air, and can perform an image formation setting according to a measured environmental temperature. [Drive Structure]

Next, a drive structure configured to rotate the developing roller 16 will be described with reference to FIG. 2. The drive structure configured to rotate the developing roller 16 is constituted of the A-motor 101, drive transmissions YA, YB, MA, MB, CA, CB, KA, KB and a D-motor 104 by a gear train. The driving structure configured to rotate the developing roller 16 includes mechanical clutches 105Y, 105M, 105C, and 105K, which are a plurality of transmission units controlled by the D-motor 104.

The A-motor 101 is a brushless motor, and a rotational force generated in the A-motor 101 is transmitted to the mechanical clutches 105Y, 105M, 105C, and 105K by the drive transmissions YA, MA, CA, and KA by the gear train, respectively. The D-motor 104 is a motor (for example, a stepping motor) configured to control a rotational position. When the D-motor 104 is rotated by a predetermined rotation amount, the driving forces transmitted from the A-motor 101 to the mechanical clutches 105Y, 105M, 105C, and 105K are successively transmitted to the developing rollers 16Y, 16M, 16C, and 16K through the drive transmissions YB, MB, CB, and KB. Thus, the developing rollers 16Y, 16M, 16C and 16K are rotated. The D-motor 104 functions as a switching unit configured to switch between a transmission state in which the mechanical clutches 105Y, 105M, 105C, and 105K transmit the driving force of the A-motor 101 to the developing rollers 16Y, 16M, 16C, and 16K, and a non-transmission state in which the driving force is not transmitted. [A-motor]

Figure 3:
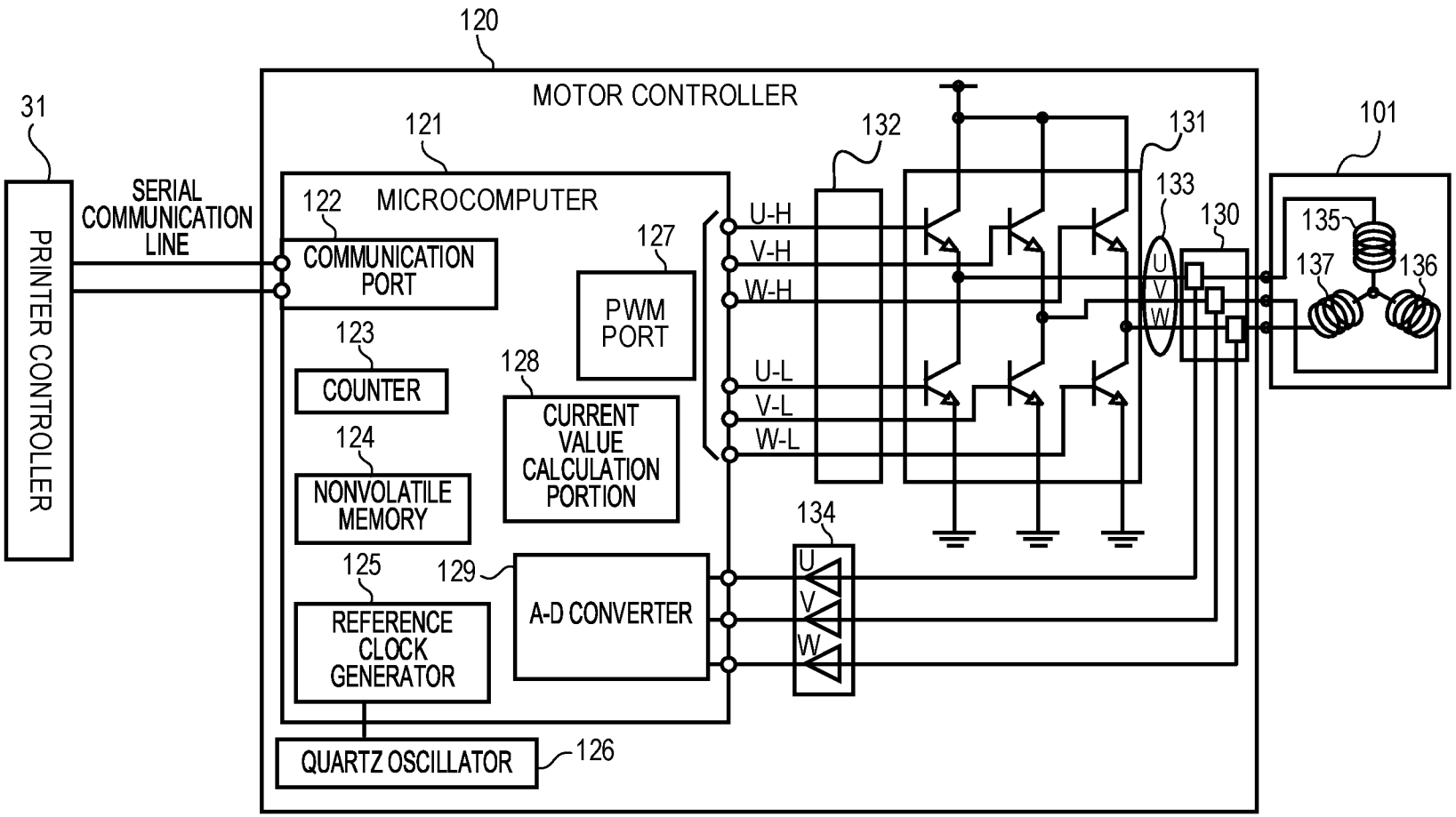
FIG. 3 shows a circuit of a motor controller of the first and second embodiments.

Next, a motor structure configured to rotate the A-motor 101 will be described. FIG. 3 shows a configuration of a motor controller 120 serving as a control unit. First, the motor controller 120 will be described in more detail. The motor controller 120 is a circuit configured to rotate the A-motor 101. The motor controller 120 includes, for example, a microcomputer 121 as an arithmetic processing unit. The microcomputer 121 incorporates a communication port 122, an A-D converter 129, a counter 123, a nonvolatile memory 124, a reference clock generator 125, a PWM port 127, and a current value calculation portion 128.

The counter 123 performs a counting operation on the basis of a reference clock generated by the reference clock generator 125 on a basis of a frequency signal of a quartz oscillator 126, and measures a cycle of an input pulse signal base on the count value, and generates a PWM signal. The PWM port 127 as an output unit is provided with six terminals, and outputs PWM signals of three high-side signals (U-H, V-H, W-H) and three low-side signals (U-L, V-L, W-L). The motor controller 120 includes a 3-phase inverter 131 composed of 3 high side switching elements and 3 low side switching elements. As the switching element, for example, a transistor or a field effect transistor (hereinafter referred to as FET) can be used. Each switching element is connected to the PWM port 127 via a gate driver 132, and can be controlled to be ON or OFF (ON/OFF) by the PWM signal outputted from the PWM port 127. Each switching element has the PWM signal turning on at a high level (hereinafter referred to as H) and the PWM signal turning off at a low level (hereinafter referred to as L), but the turning on/off of the PWM signal may be reversed.

The U, V, and W phase outputs 133 of the inverter 131 are connected to coils 135, 136, and 137 of the A-motor 101, respectively, and can control the currents (hereinafter referred to as coil current) flowing through the coils 135, 136, and 137, respectively. The coil currents flowing through the coils 135, 136, and 137 are detected by a current detection portion serving as a detection unit. The current detection portion includes a current sensor 130, an amplifier 134, the A-D converter 129, and the current value calculation portion 128. First, the current flowing through the coils 135, 136, and 137 is converted into a voltage by the current sensor 130. The voltage converted by the current sensor 130 is amplified by the amplifier 134, and an offset voltage is applied to the voltage by the amplifier 134, and the voltage is input to the A-D converter 129 of the microcomputer 121. For example, if the current sensor 130 outputs a voltage of 0.01 V per 1 A, an amplification factor of the amplifier 134 is 10 times, and the applied offset voltage is 1.6 V, the output voltage of the amplifier 134 when a current of −(minus)10 A to +(plus) 10 A flows becomes 0.6 to 2.6 V.

The A-D converter 129 converts, for example, a voltage of 0 to 3 V, which is an analog value, into a digital value of 0 to 4095, and outputs a converted voltage. Therefore, in a case in which a current of— (minus) 10 A to +(plus) 10 A flows, the digital value is approximately 819 to 3549. Regarding to the positive or negative value of the current, a case in which the current flows from the 3-phase inverter 131 to the A-motor 101 is referred to as +(plus). The current value calculation portion 128 calculates a current value by applying a predetermined calculation to analog-to-digital (hereinafter referred to as AD) converted data (hereinafter referred to as an AD value). That is, the current value calculation portion 128 subtracts the offset value from the AD value and multiplies it by a predetermined coefficient to obtain a current value. Since the offset value will be the AD value of the offset voltage 1.6 V, it is approximately 2184, and the predetermined coefficient is approximately 0.00733. For the offset value, the AD value in a case in which the coil current is not flowing is read and stored in a temporary storage unit (not shown) for use. The coefficient is previously stored in a nonvolatile memory 124 as a standard coefficient.

The microcomputer 121 controls the 3-phase inverter 131 through the gate driver 132 to supply current to coils 135, 136 and 137 of the A-motor 101. The microcomputer 121 detects the current flowing through the coils 135, 136 and 137 by the current sensor 130, the amplifier 134 and the A-D converter 129, and calculates a rotor position and speed of the A-motor 101 from the detected current flowing through the coils 135, 136 and 137. Thus, the microcomputer 121 can control the rotation of the A-motor 101. The communication port 122 transmits and receives information to and from the printer controller 31 via, for example, a serial communication line. [Structure of the A-Motor]

Figure 4A:
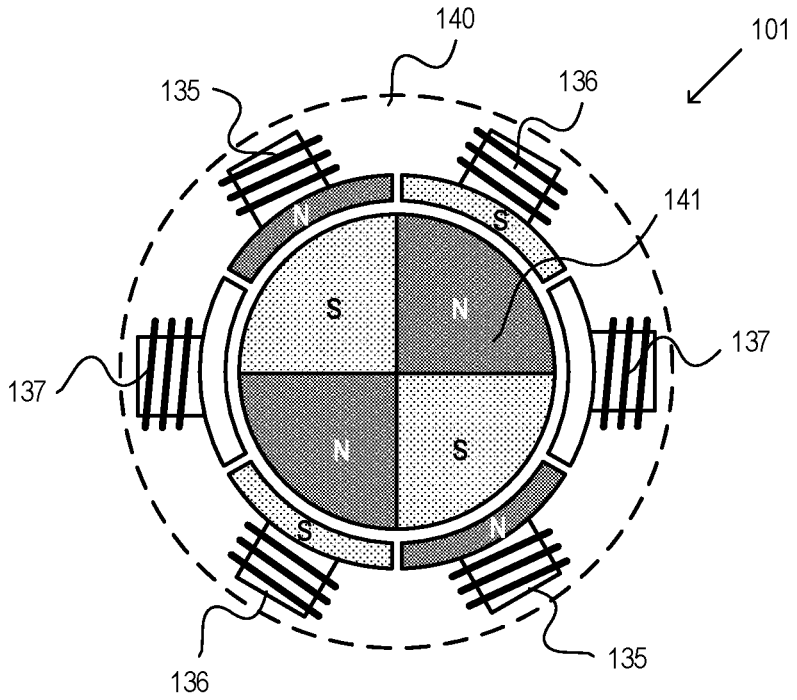
FIG. 4A shows a structure of the A-motor of the first embodiment.

Next, a structure of the A-motor 101 will be described with reference to FIG. 4A. The A-motor 101 includes a 6-slot stator 140 and a 4-pole rotor 141, and the stator 140 includes U-phase coil 135, V-phase coil 136, and W-phase coil 137 wound around stator cores, respectively. The rotor 141 is constituted of permanent magnets and includes two sets of N poles/S poles. The U-phase coil 135, the V-phase coil 136, and the W-phase coil 137 are connected to the inverter 131. [Operation of the A-Motor and the Developing Roller]

Figure 4B:
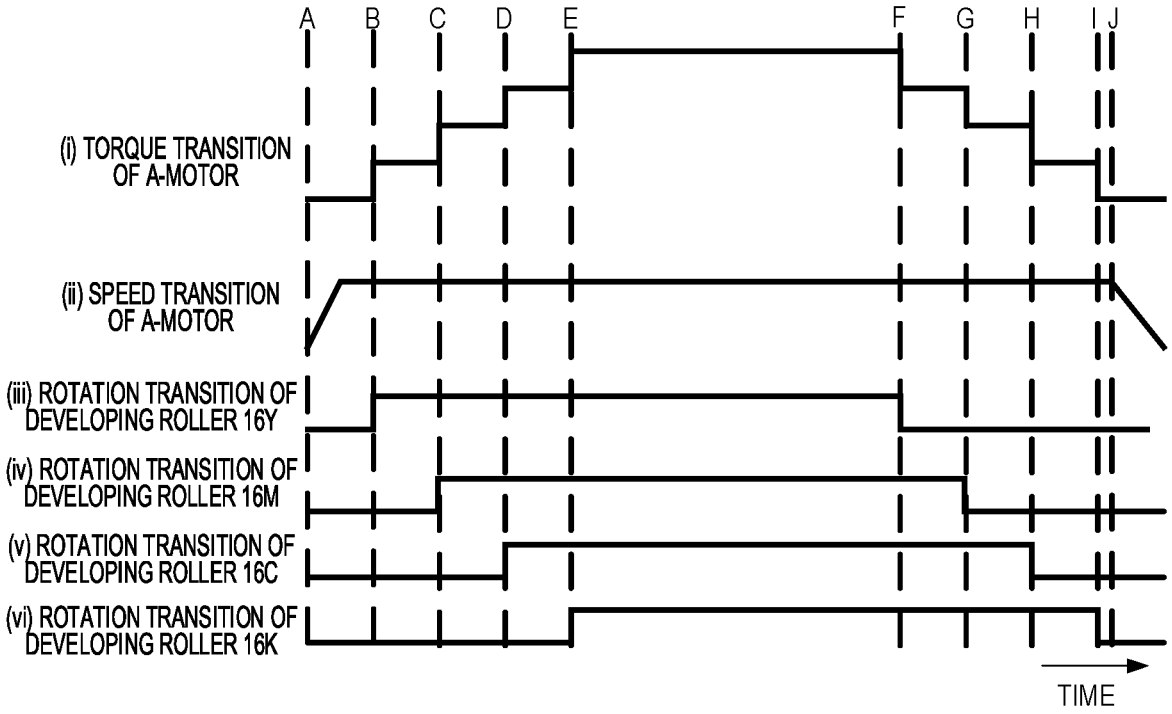
FIG. 4B shows a sequence of a motor drive.

Next, the operations of the A-motor 101 and the developing roller 16, which is a load of the A-motor 101, according to the first embodiment will be described with reference to FIG. 4B. FIG. 4B shows (i) a torque transition of the A-motor 101, (ii) a speed transition of the A-motor 101, (iii) a rotation transition of the developing roller 16Y, (iv) a rotation transition of the developing roller 16M, (v) a rotation transition of the developing roller 16C, and (vi) a rotation transition of the developing roller 16K. In the rotation transitions of the developing rollers 16Y, 16M, 16C, and 16K, anon-rotating state is indicated at a low level, and a rotating state is indicated at a high level. The horizontal axis indicates time, and A, B, C, D, E, F, G, H, I, and J indicate timings, respectively.

First, at the timing A, the motor controller 120 activates the A-motor 101 in a non-connected state in which all developing rollers 16Y, 16M, 16C, and 16K are disconnected from the A-motor 101. Subsequently, the motor controller 120 starts rotating the D-motor 104 with the A-motor 101 rotating at a predetermined speed to connect the mechanical clutch 105Y at the timing B so as to start rotating the developing roller 16Y. Similarly, the motor controller 120 connects the mechanical clutches 105M, 105C and 105K at the timings C, D and E, respectively, so as to start rotating the developing rollers 16M, 16C and 16K. As shown in the item (i), the torque applied to the A-motor 101 gradually increases at the timings B, C, D, and E. The motor controller 120 switches the mechanical clutches 105Y, 105M, 105C, and 105K to the transmission state at different timings so that the developing rollers 16Y, 16M, 16C, and 16K start to rotate at different timings respectively by the D-motor 104.

After a print job is completed, the motor controller 120 rotates the D-motor 104 so that the mechanical clutches 105Y, 105M, 105C, and 105K are disconnected into non-connected states, respectively, in order of the timings F, G, H, and I. Thus, the rotations of the developing rollers 16Y, 16M, 16C, and 16K are sequentially stopped. As shown in the item (i), the torque applied to the A-motor 101 gradually decreases at the timings F, G, H, and I. Finally, the motor controller 120 controls to stop the rotation of the A-motor 101 at the timing J. With such a configuration, even one motor can sequentially start the rotations of the developing rollers 16Y, 16M, 16C, and 16K immediately before the image formations of respective stations, and can sequentially stop the rotations immediately after the image formation. The motor controller 120 switches the mechanical clutches 105Y, 105M, 105C, and 105K to non-transmission states at different timings by the D-motor 104 so that the developing rollers 16Y, 16M, 16C, and 16K respectively stop rotating at different timings. A predetermined number of print operations are performed from the timing E to the timing F.

The amounts of change (hereinafter referred to as torque variation) in the torque applied to the A-motor 101 at the timings B, C, D, and E in this sequence are the torques corresponding to the developing rollers 16Y, 16M, 16C, and 16K, respectively. The amounts of change in the torque applied to the A-motor 101 at the timings F, G, H, and I are also torques corresponding to the developing rollers 16Y, 16M, 16C, and 16K, respectively. Therefore, the torques of the developing rollers 16Y, 16M, 16C, and 16K can be detected by detecting the amounts of change in the torque applied to the A-motor 101. [Method of Calculating Torque of Developing Roller]

Figure 5A:
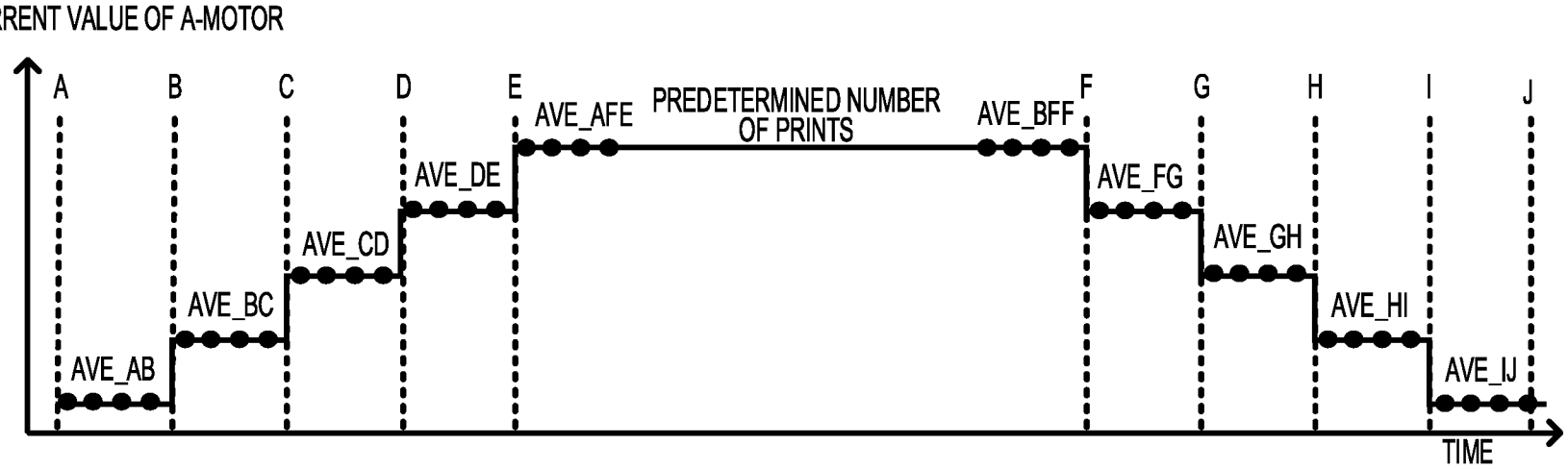
FIG. 5A and FIG. 5B show control of the first embodiment.

A method of calculating each torque of the developing rollers 16Y, 16M, 16C, and 16K in the first embodiment will be described with reference to FIG. 5A. FIG. 5A is a graph showing time on the horizontal axis and the current value of the A-motor 101 on the vertical axis. The reference signs A, B, C, D, E, F, G, H, I, and J in the graph correspond to the timings A, B, C, D, E, F, G, H, I, and J in FIG. 4B, respectively. As described with reference to FIG. 4B, the motor controller 120 starts rotating the D-motor 104 to connect the mechanical clutch 105Y at the timing B to start rotating the developing roller 16Y. Similarly, the motor controller 120 starts rotating the developing rollers 16M, 16C and 16K to connect the mechanical clutches 105M, 105C and 10K at the timings C, D and E, respectively. As shown in the item (i) of FIG. 4B, the torque applied to the A-motor 101 increases at respective timings at which the developing rollers 16Y, 16M, 16C, and 16K starts to rotate, so that the current value increases at the respective timings at the which the developing rollers 16Y, 16M, 16C, and 16K starts to rotate as shown in FIG. 5A.

The motor controller 120 calculates the current value flowing in the A-motor 101 by the current value calculation portion 128. The CPU 32 of the printer controller 31 obtains the current value calculated by the current value calculation portion 128 from the motor controller 120. Here, an average value (hereinafter referred to as a current average value) of the current value between the timing A and the timing B is assumed to be AVE_AB, and the average value of the current between the timing B and the timing C is assumed to be AVE_BC. The current average value between the timing C and the timing D is assumed to be AVE_CD, and the current average value between the timing D and the timing E is assumed to be AVE_DE. Further, the current average value for a predetermined time, for example, a few seconds from the timing E is assumed to be AVE_AFE. Values (hereinafter referred to as torque equivalent values) Ty1, Tm1, Tc1, and Tk1 corresponding to respective torques of the developing rollers 16Y, 16M, 16C, and 16K on the axis of the A-motor 101 can be expressed by the following expressions (1) to (4). The CPU 32 obtains the current average values from the obtained current values, and obtains the torque equivalent values from the current average values.

$$Ty1=Kt\times(AVE_BC-AVE_AB) \quad \text{Expression (1)}$$

$$Tm1=Kt\times(AVE_CD-AVE_BC) \quad \text{Expression (2)}$$

$$Tc1=Kt\times(AVE_DE-AVE_CD) \quad \text{Expression (3)}$$

$$Tk1=Kt\times(AVE_AFE-AVE_DE) \quad \text{Expression (4)}$$

Kt: torque constant

As described above, a difference between the current values (specifically, the current average values) before and after the transition from the non-transmission state to the transmission state of each of the mechanical clutches 105Y, 105M, 105C, and 105K is proportional to each of the torque equivalent values Ty1, Tm1, Tc1, and Tk1.

In the above description, the torque equivalent values Ty1, Tm1, Tc1, and Tk1 are calculated by multiplying the current average values by the torque constant Kt, and the respective torques of the developing rollers 16Y, 16M, 16C, and 16K are calculated. However, it is also effective in the present embodiment to use, in the subsequent determination, the result of obtaining the current values corresponding to the developing rollers 16Y, 16M, 16C, and 16K, such as absolute current values of AVE_AB, AVE_BC, AVE_CD, AVE_DE, AVE_AFE, that is, the sum current values of the plurality of developing rollers, the difference between AVE_BC and AVE_AB, the difference between AVE_CD and AVE_BC, the difference between AVE_DE and AVE_CD, and the difference between AVE_AFE and AVE_DE.

After a predetermined number of prints are completed, the motor controller 120 starts the rotation of the D-motor 104 again, thereby disconnecting the mechanical clutch 105Y at the timing F and stopping the rotation of the developing roller 16Y. Similarly, the motor controller 120 stops the rotation of the developing rollers 16M, 16C and 16K by disconnecting the mechanical clutches 105M, 105C and 105K at the timings G, H and I, respectively. As shown in the item (i) of FIG. 4B, since the torque applied to the A-motor 101 decreases at the timings at which the developing rollers 16Y, 16M, 16C, and 16K stop rotating, respectively, the current value decreases at the timings at which the developing rollers 16Y, 16M, 16C, and 16K start to stop, respectively, as shown in FIG. 5A. AVE_BFF is a current average value for a predetermined time, for example, for a few seconds before the timing F. A current average value between the timing F and the timing G is AVE_FG, and a current average value between the timing G and the timing H is AVE_GH. Further, a current average value between the timing H and the timing I is AVE_HI, and a current average value between the timing I and the timing J is AVE_IJ. The torque equivalent values Ty2, Tm2, Tc2, and Tk2 of the developing rollers 16Y, 16M, 16C, and 16K on the axis of the A-motor 101 can be expressed by the following expressions (5) to (8).

$$Ty2=Kt\times(AVE_BFF-AVE_FG) \quad \text{Expression (5)}$$

$$Tm2=Kt\times(AVE_FG-AVE_GH) \quad \text{Expression (6)}$$

$$Tc2=Kt\times(AVE_GH-AVE_HI) \quad \text{Expression (7)}$$

$$Tk2=Kt\times(AVE_HI-AVE_IJ) \quad \text{Expression (8)}$$

Kt: torque constant

As described above, the difference between the current values (specifically, the current average values) before and after the transition from the transmission state to the non-transmission state of each of the mechanical clutches 105Y, 105M, 105C, and 105K is proportional to each of the torque equivalent values Ty2, Tm2, Tc2, and Tk2.

In the above description, the torque equivalent values Ty2, Tm2, Tc2, and Tk2 are calculated by multiplying the current average values by the torque constant Kt, and the torques of the developing rollers 16Y, 16M, 16C, and 16K are calculated. However, a method of using, in the subsequent determination, the result of obtaining the current values corresponding to the developing rollers 16Y, 16M, 16C, 16K, such as the absolute current values of the AVE_BFF, AVE_FG, AVE_GH, AVE_HI, and AVE_IJ, that is, the sum current value of the plurality of developing rollers, the difference between AVE_BFF and AVE_FG, the difference between AVE_FG and AVE_GH, the difference between AVE_GH and AVE_HI, and the difference between AVE_HI and AVE_IJ are also effective in the embodiment.

As described above, the CPU 32 can calculate the torque equivalent values Ty1, Tm1, Tc1, and Tk1 of the developing rollers 16Y, 16M, 16C, and 16K immediately before the start of printing, and the torque equivalent values Ty2, Tm2, Tc2, and Tk2 of the developing rollers 16Y, 16M, 16C, and 16K immediately after the end of printing. The CPU 32 functions as a calculation unit configured to calculate the respective torque values of the developing rollers 16Y, 16M, 16C, and 16K based on the current value when the D-motor 104 is in the non-transmission state and the current value when the D-motor is in the transmission state. In the first embodiment, the configuration in which the one motor (A-motor 101) drives the four developing rollers 16Y, 16M, 16C, and 16K is described. However, a configuration in which one motor drives one photosensitive drum 13 and two developing rollers 16 is also possible, and the invention is not limited to the configuration in the first embodiment. That is, the present invention is applicable to a configuration in which at least one or more rotary members are driven by one motor.

[Example of use of Torque Equivalent Value]

Figure 5B:
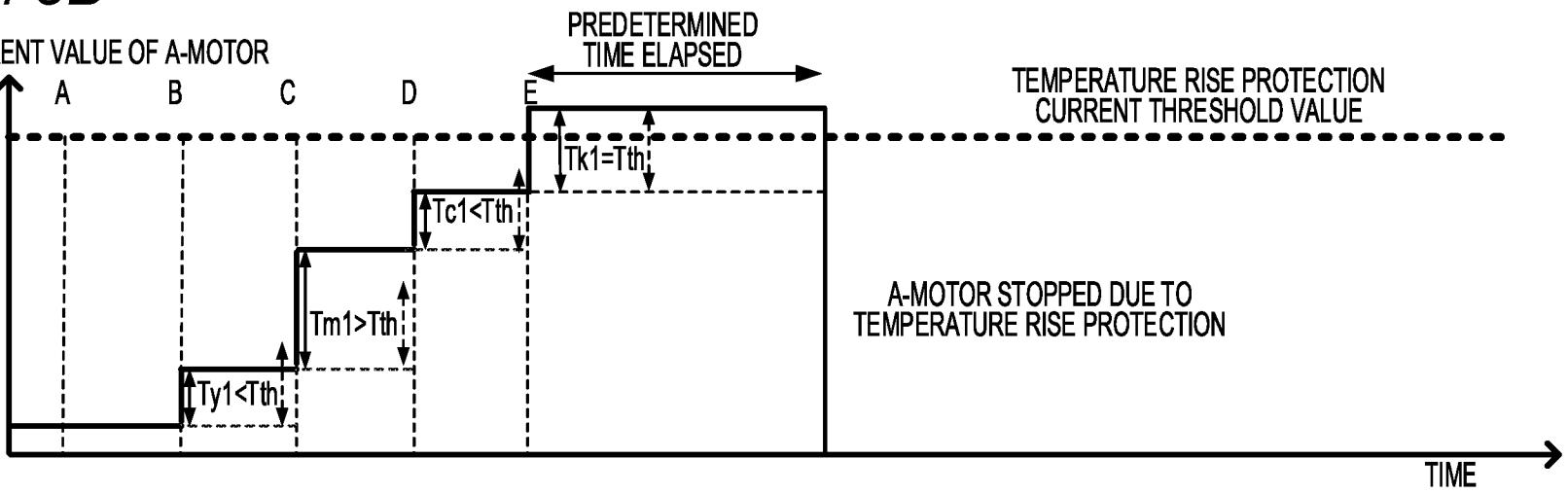

Next, in FIG. 5B, a specific example of use of the torque equivalent value of each developing roller 16 of the first embodiment will be described. In FIG. 5B, an example of notifying the user of which developing roller 16 is causing an overcurrent after the A-motor 101 stops due to a temperature rise protection will be described.

FIG. 5B is a graph showing time on the horizontal axis and the current value of the A-motor 101 on the vertical axis. The reference signs A, B, C, D, and E indicate the above-mentioned timings A, B, C, D, and E. As shown in Expressions (1) to (8) above, the difference between the current values before and after the transition from the non-transmission state to the transmission state or before and after the transition from the transmission state to the non-transmission state of each of the mechanical clutches 105Y, 105M, 105C, and 105K is proportional to the torque equivalent value. For this reason, in the graph of FIG. 5B, the torque equivalent values are indicated by the solid line double-headed arrows in the difference between the current values (step portions in the graph). The broken line double-heads arrows indicate a predetermined threshold value Tth, which is a first threshold value to be described later. Such an explanation about the graph is similarly applied to FIG. 7 of a second embodiment described later. In FIG. 5B, a dashed line indicates a current value (hereinafter referred to as a temperature rise protection current threshold value) serving as a second threshold value when the A-motor 101 is stopped for the temperature rise protection. In a case in which the current value of the A-motor 101 exceeds the temperature rise protection current threshold value of the A-motor 101 for a predetermined time or more, a protection operation is performed so that the current value or the operation of the A-motor 101 is limited in order to prevent damage to the A-motor 101. In the case in which the current value of the A-motor 101 exceeds the temperature rise protection current threshold value of the A-motor 101 for the predetermined time or more, the A-motor 101 is stopped, for example, in the first embodiment.

As described with reference to FIG. 5A, the motor controller 120 starts the rotation of each developing roller 16 during the period from the timing A to the timing E, and the CPU 32 calculates the torque equivalent values Ty1, Tm1, Tc1, and Tk1 of respective developing rollers 16 immediately before the start of printing. Thereafter, the CPU 32 stops the A-motor 101 by the motor controller 120 in order to prevent damage to the A-motor 101 if the state in which the detected current value is equal to or greater than the temperature rise protection current threshold value continues for the predetermined time or longer after the timing E.

A developing roller 16 of a station of which a torque equivalent value among the torque equivalent values Ty1, Tm1, Tc1, and Tk1 of the developing rollers 16Y, 16M, 16C, and 16K calculated immediately before the stop of the A-motor 101 has exceeded the predetermined threshold value Tth is hereinafter referred to as the overload developing roller. In FIG. 5B, the torque equivalent value Ty1 of the developing roller 16Y is smaller than the predetermined threshold value Tth (Ty1<Tth). The torque equivalent value Tc1 of the developing roller 16C is smaller than the predetermined threshold value Tth (Tc1<Tth). The torque equivalent value Tk1 of the developing roller 16K is equivalent to the predetermined threshold value Tth (Tk1=Tth). However, the torque equivalent value Tm1 of the developing roller 16M is larger than the predetermined threshold value Tth (Tm1>Tth). That is, the CPU 32 of the printer controller 31 identifies the developing roller 16M as the overload developing roller. The CPU 32 serves as a determination unit configured to compare the torque value of the developing roller with the predetermined threshold value, and determine that the developing roller having the torque value larger than the predetermined threshold value is the overload developing roller. The CPU 32 informs the user and the service person of the information on the overload developing roller (the developing roller 16M in FIG. 5B) on the screen of the display panel 33 and/or the personal computer (hereinafter referred to as PC) to which the image forming apparatus is connected.

Although the method of determining the overload by obtaining the torque equivalent values has been described above, the present invention is not limited thereto. For example, in the case in which the result of obtaining the current values corresponding to the developing rollers 16Y, 16M, 16C, 16K, such as the absolute current values of the AVE_AB, AVE_BC, AVE_CD, AVE_DE, and AVE_AFE, that is, the sum current value of the plurality of developing rollers, the difference between AVE_BC and AVE_AB, the difference between AVE_CD and AVE_BC, the difference between AVE_DE and AVE_CD, the difference between AVE_AFE and AVE_DE is larger than the predetermined threshold value, the CPU 32 determines that the developing roller is the overload developing roller, and informs the user and the service man of the information on the overload developing roller (developing roller 16M in FIG. 5B) on the screen of the display panel 33 and/or the PC to which the image forming apparatus is connected.

As described above, by notifying the user and the service person of the overload developing roller 16 causing the failure, it is possible to replace only the overload developing roller causing the failure without unnecessary replacement of a developing roller 16. In the first embodiment, in the case in which the torque equivalent values Ty1, Tm1, Tc1, and Tk1 of the developing rollers 16Y, 16M, 16C, and 16K, respectively, exceed the predetermined threshold value Tth, it is considered to be the overload developing roller, but the method of determining the overload developing roller is not limited to the first embodiment, and may be a method of determining a developing roller 16 with the highest torque as the overload developing roller.

[Determination Process of Overload Developing Roller]

Figures 6, 6A:
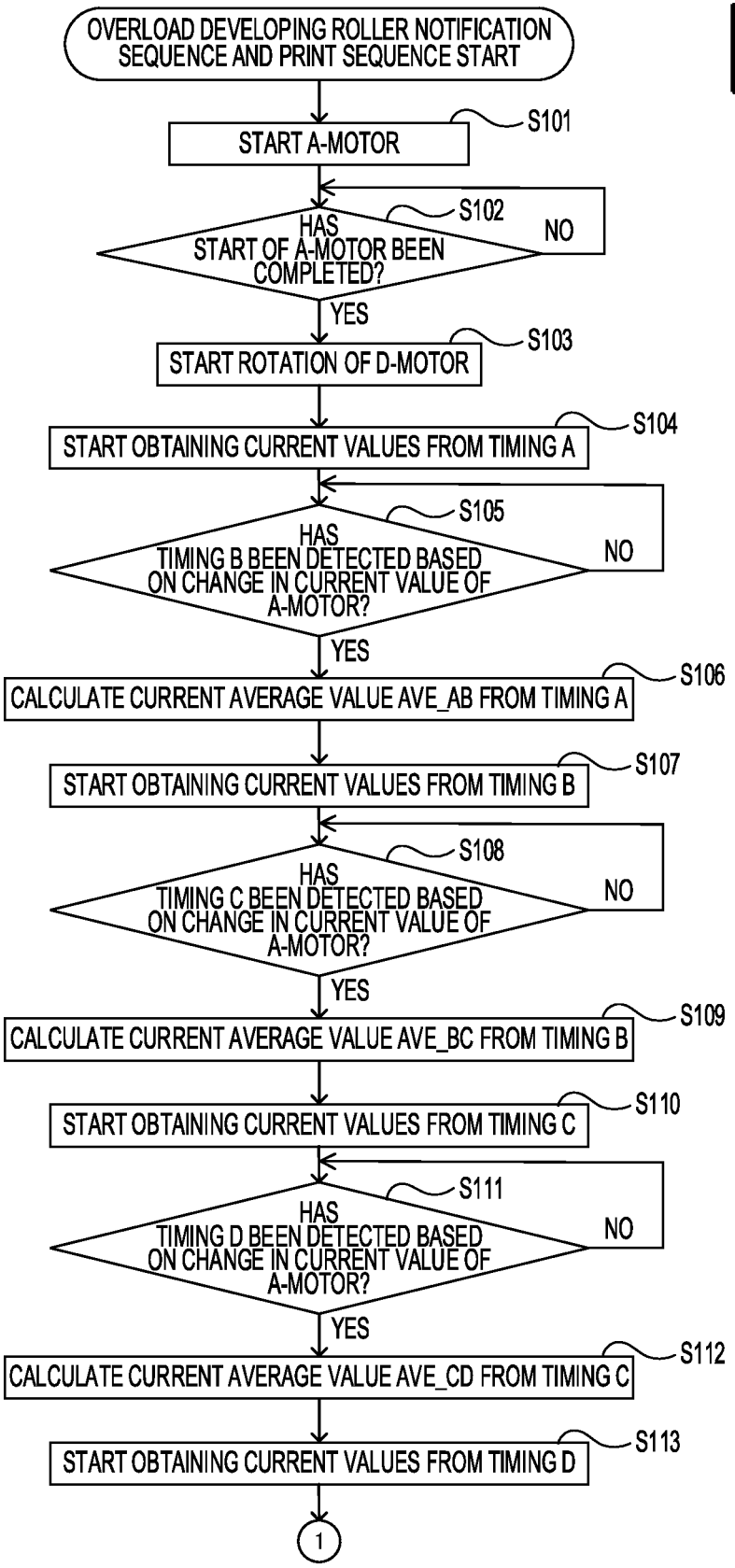
FIG. 6, which is comprised collectively of FIG. 6A and FIG. 6B, is a flowchart showing the control of the first embodiment.
Figure 6B:
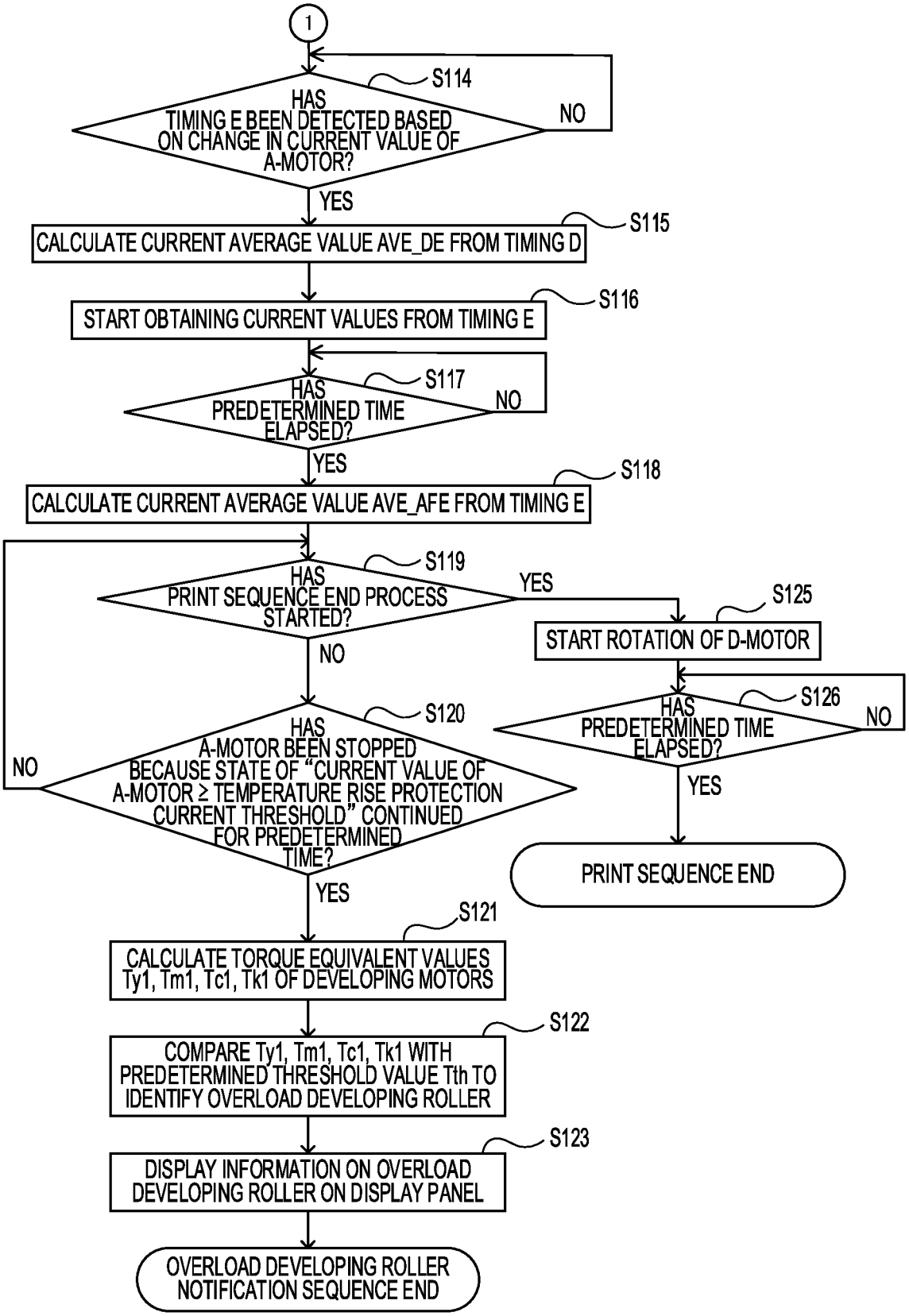

Next, a determination process of the overload developing roller of the first embodiment will be described with reference to a flowchart of FIG. 6, which is comprised collectively of FIGS. 6A and 6B. In a case in which the notification sequence and the print sequence of the overload developing roller are started, the CPU 32 starts the processing of step (hereinafter referred to as S) S101 and subsequent steps. In S101, the CPU 32 starts the A-motor 101 by the motor controller 120. In S102, the CPU 32 determines whether or not an activation of the A-motor 101 is completed via the motor controller 120. In S102, if it is determined that the activation of the A-motor 101 has not been completed, the CPU 32 returns the process to S102, and if it is determined that the activation of the A-motor 101 has been completed, the process proceeds to S103.

In S103, the CPU 32 starts rotation of the D-motor 104 by the motor controller 120. In S104, the CPU 32 obtains a current value in order to obtain the current average value AVE_AB of the A-motor 101 from the timing A. In S105, the CPU 32 monitors the current value of the A-motor 101 to determine whether the timing B has been detected from the change in the current value. Here, the change in the current value is a change in the current value associated with the connection of the developing roller 16Y, as shown in FIG. 5A. It is assumed that a value of the change in the current value when the developing roller 16Y is connected is obtained in advance by an experiment, and is stored in the ROM 32*a*. Thereafter, the same shall apply to the timings C, D, and E. In S105, if it is determined that the timing B has not been detected, the CPU 32 returns the process to S105, and if it is determined that the timing B has been detected, the process proceeds to S106. In S106, the CPU 32 determines (calculates) the current average value AVE_AB of the A-motor 101 from the timing A.

In S107, the CPU 32 starts to obtain the current value in order to obtain the current average value AVE_BC of the A-motor 101 from the timing B. In S108, the CPU 32 monitors the current value of the A-motor 101 to determine whether the timing C has been detected from a change in the current value. In S108, if it is determined that the timing C has not been detected, the CPU 32 returns the process to S108, and if it is determined that the timing C has been detected, the process proceeds to S109. In S109, the CPU 32 obtains the current average value AVE_BC of the A-motor 101 from the timing B.

In S110, the CPU 32 starts to obtain the current value in order to obtain the current average value AVE_CD of the A-motor 101 from the timing C. In S111, the CPU 32 monitors the current value of the A-motor 101 to determine whether the timing D has been detected from a change in the current value. In S111, if it is determined that the timing D has not been detected, the CPU 32 returns the process to S111, and if it is determined that the timing D has been detected, the process proceeds to S112. In S112, the CPU 32 obtains the current average value AVE_CD of the A-motor 101 from the timing C.

In S113, the CPU 32 starts to obtain the current value in order to obtain the current average value AVE_DE of the A-motor 101 from the timing D. In S114, the CPU 32 monitors the current value of the A-motor 101 to determine whether the timing E has been detected from a change in the current value. In S114, if it is determined that the timing E is not detected, the CPU 32 returns the process to S114, and if it is determined that the timing E is detected, the process proceeds to S115. In S115, the CPU 32 obtains the current average value AVE_DE of the A-motor 101 from the timing D.

In S116, after the predetermined time has elapsed, the CPU 32 starts to acquire a current value in order to obtain the current average value AVE_AFE of the A-motor 101 from the timing E. The CPU 32 resets and starts the timer 32*c*. In S117, the CPU 32 refers to the timer 32*c* to determine whether the predetermined time has elapsed. In S117, if it is determined that the predetermined time has not elapsed, the CPU 32 returns the process to S117, and if it is determined that the predetermined time has elapsed, the process proceeds to S118. In S118, the CPU 32 obtains the current average value AVE_AFE of the A-motor 101 within the predetermined time from the timing E. In S119, the CPU 32 determines whether or not a print operation (print sequence) end process of a predetermined number of sheets has been started. If it is determined in S119 that the print sequence end process has been started, the CPU 32 determines that the operation is normally progressing, and advances the process to S125. If it is determined in S119 that the print sequence end process has not been started, the CPU 32 advances the process to S120.

In S120, the CPU 32 determines whether or not the A-motor 101 has been stopped because the state in which the current value of the A-motor 101 is equal to or greater than the temperature rise protection current threshold value continues for the predetermined time or longer. That is, the CPU 32 determines whether or not the A-motor 101 has been stopped because the state of "the current value of the A-motor 101 the temperature rise protection current threshold value" continues for the predetermined time or longer. In S120, if it is determined that the A-motor 101 is not stopped, the CPU 32 returns the process to S119, and if it is determined that the A-motor 101 is stopped, the process advances to S121. In S121, the CPU 32 calculates the torque equivalent values Ty1, Tm1, Tc1, and Tk1 of the developing rollers 16Y, 16M, 16C, and 16K, respectively, using the expressions (1), (2), (3), and (4) described in FIG. 5A. In S122, the CPU 32 compares the torque equivalent values Ty1, Tm1, Tc1, and Tk1 of the developing rollers 16 with the predetermined threshold value Tth. The CPU 32 identifies a developing roller 16 of a station exceeding the predetermined threshold value Tth as the overload developing roller to identify the overload developing roller. In S123, the CPU 32 displays information on the overload developing roller identified in S122 on the screen of the display panel 33 or the PC (not shown), and ends the overload developing roller notification sequence. In S125, the CPU 32 starts the rotation of the D-motor 104. Thus, the rotations of the developing rollers 16 are sequentially stopped. In S126, the CPU 32 determines whether or not the predetermined time has elapsed. In S126, if it is determined that the predetermined time has not elapsed, the CPU 32 returns the process to S126, and if it is determined that the predetermined time has elapsed, the print sequence ends.

In the first embodiment, the torque equivalent values Ty1, Tm1, Tc1, and Tk1 of the developing rollers 16Y, 16M, 16C, and 16K immediately before the start of printing are used to identify the overload developing roller as a cause of failure. However, the identifying method of identifying the overload developing roller which is the cause of failure by using the torque equivalent values Ty2, Tm2, Tc2, and Tk2 of the developing rollers 16Y, 16M, 16C, and 16K immediately after the printing is ended is not limited to the first embodiment. In a configuration in which a plurality of rollers are driven by one motor, the plurality of rollers are not limited to the developing rollers, but may be other rollers. As described above, by notifying the user and the service person of an overload roller that causes the failure, it is possible to prevent unnecessary replacement of a roller and replace only the overload roller that causes the failure.

As described above, according to the first embodiment, the plurality of rollers can be driven by one motor. Further, even in the configuration in which the plurality of rollers are driven by the one motor, the torque value of each roller can be obtained.

Second Embodiment

[Detection of Sign of Failure]

Figure 7:
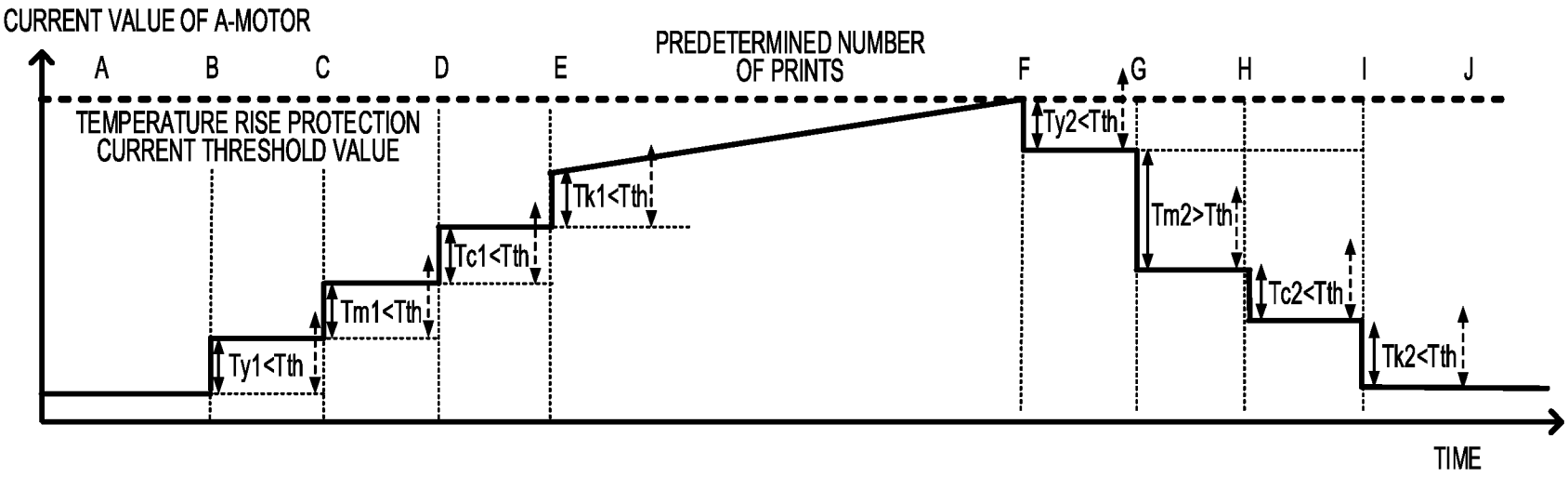
FIG. 7 shows control of the second embodiment.

In the first embodiment, an example of identifying the overload developing roller which is a cause of failure after the A-motor 101 stops due to the temperature rise protection has been described. In a second embodiment, an example in which before a stop of the A-motor 101 occurs, a sign of that will be notified will be described. In the second embodiment, even if a state in which the current value of the A-motor 101 is equal to or greater than the temperature rise protection current threshold value continues for less than the predetermined time or the current value of the A-motor 101 is less than the temperature rise protection current threshold value, a presence or absence of an overload developing roller is determined, and if there is an overload developing roller, the overload developing roller 16 is identified. In the following, different points in the second embodiment from the first embodiment will be mainly described, and the same reference numerals will be assigned to the same components as those of the first embodiment, and the description thereof will be omitted. With reference to FIG. 7, an example of notifying which developing roller 16 has a heavier torque than expected before the A-motor 101 stops due to the temperature rise protection will be described.

In FIG. 7, time is shown on the horizontal axis, and the current value of the A-motor 101 is shown on the vertical axis. A broken line represents the temperature rise protection current threshold value of the A-motor 101. The timings A to J are the same as those in FIG. 5A. In the second embodiment, if the state in which the current value of the A-motor 101 exceeds the temperature rise protection current threshold value continues for the predetermined time or longer, the protection operation is performed so that the current value or the operation is limited in order to prevent damage to the A-motor 101. As described with reference to FIG. 5A, in the period from the timing A to the timing E, the developing rollers 16Y, 16M, 16C, and 16K start to rotate, and the CPU 32 calculates the respective torque equivalent values Ty1, Tm1, Tc1, and Tk1 of the developing rollers 16Y, 16M, 16C, and 16K immediately before a start of printing. The CPU 32 compares the predetermined threshold value Tth with each of the torque equivalent values Ty1, Tm1, Tc1, and Tk1. In a case in which any one of the torque equivalent values Ty1, Tm1, Tc1, and Tk1 of the developing rollers 16Y, 16 M, 16C, and 16K is larger than the predetermined threshold value Tth, the CPU 32 identifies the developing roller 16 of the station as the overload developing roller.

After the predetermined number of prints are completed, the developing rollers 16Y, 16M, 16C, and 16K stop rotating in the period from the timing F to the timing J as described in FIG. 5A, and the CPU 32 calculates the respective torque equivalent values Ty2, Tm2, Tc2, and Tk2 of the developing rollers 16Y, 16M, 16C, and 16K immediately after the end of the printing. The CPU 32 compares the predetermined threshold value Tth with each of the torque equivalent values Ty2, Tm2, Tc2, and Tk2. In a case in which any one of the torque equivalent values Ty2, Tm2, Tc2 and Tk2 of the developing rollers 16Y, 16M, 16C and 16K is larger than the predetermined threshold value Tth, the CPU 32 identifies the developing roller 16 of the station as the overload developing roller.

For example, in FIG. 7, the torque equivalent value Tm2 of the developing roller 16M immediately after the end of the printing is larger than the predetermined threshold value Tth (Tm2>Tth). That is, in the next print sequence, the A-motor 101 may be stopped due to the developing roller 16M. This is a sign. The CPU 32 identifies the developing roller 16M as the overload developing roller. The CPU 32 informs the user and the service person of information on the overload developing roller together with an information about a possibility of causing an excessive temperature rise of the A-motor 101 in a future on the screen of the display panel 33 and/or the PC (not shown). Before the A-motor 101 stops due to the abnormality of the developing roller 16, the user and the service person can order a new developing roller 16 in advance. Note that in a case in which there is an overload developing roller before a start of printing in a state in which the A-motor 101 is not stopped because the state in which the current value of the A-motor 101 is equal to or greater than the temperature rise protection current threshold value continues for less than the predetermined time or the current value of the A-motor 101 is less than the temperature rise protection current threshold value, the printing operation is continued. The CPU 32 displays the information about the overload developing roller on the display panel 33 while continuing the printing operation.

In the second embodiment, the CPU 32 compares the torque equivalent values Ty1, Tm1, Tc1, and Tk1 of the developing rollers 16Y, 16M, 16C, and 16K immediately before the start of printing and the torque equivalent values Ty2, Tm2, Tc2, and Tk2 of the developing rollers 16Y, 16M, 16C, and 16K immediately after the end of printing with the predetermined threshold value Tth prepared in advance. The example in which in the case in which any one of the torque equivalent values Ty1, Tm1, Tc1, Tk1, Ty2, Tm2, Tc2, and Tk2 of the developing rollers 16Y, 16M, 16C, and 16K is larger than the predetermined threshold value Tth, the CPU 32 determines the developing roller 16 of the station as the overload developing roller. However, a ratio of the torque equivalent value of the developing roller to the predetermined threshold value may be displayed on the display panel 33 and/or the screen of the PC (not shown) for each station. That is, the CPU 32 may compare the torque value of the developing roller with the predetermined threshold value and determine whether the developing roller is the overload developing roller based on the ratio of the torque value to the predetermined threshold value. As described above, the calculation method and the display method on the display panel 33 and/or the screen of the PC are not limited to the second embodiment.

[Determination Process of Overload Developing Roller]

Figures 8, 8A:
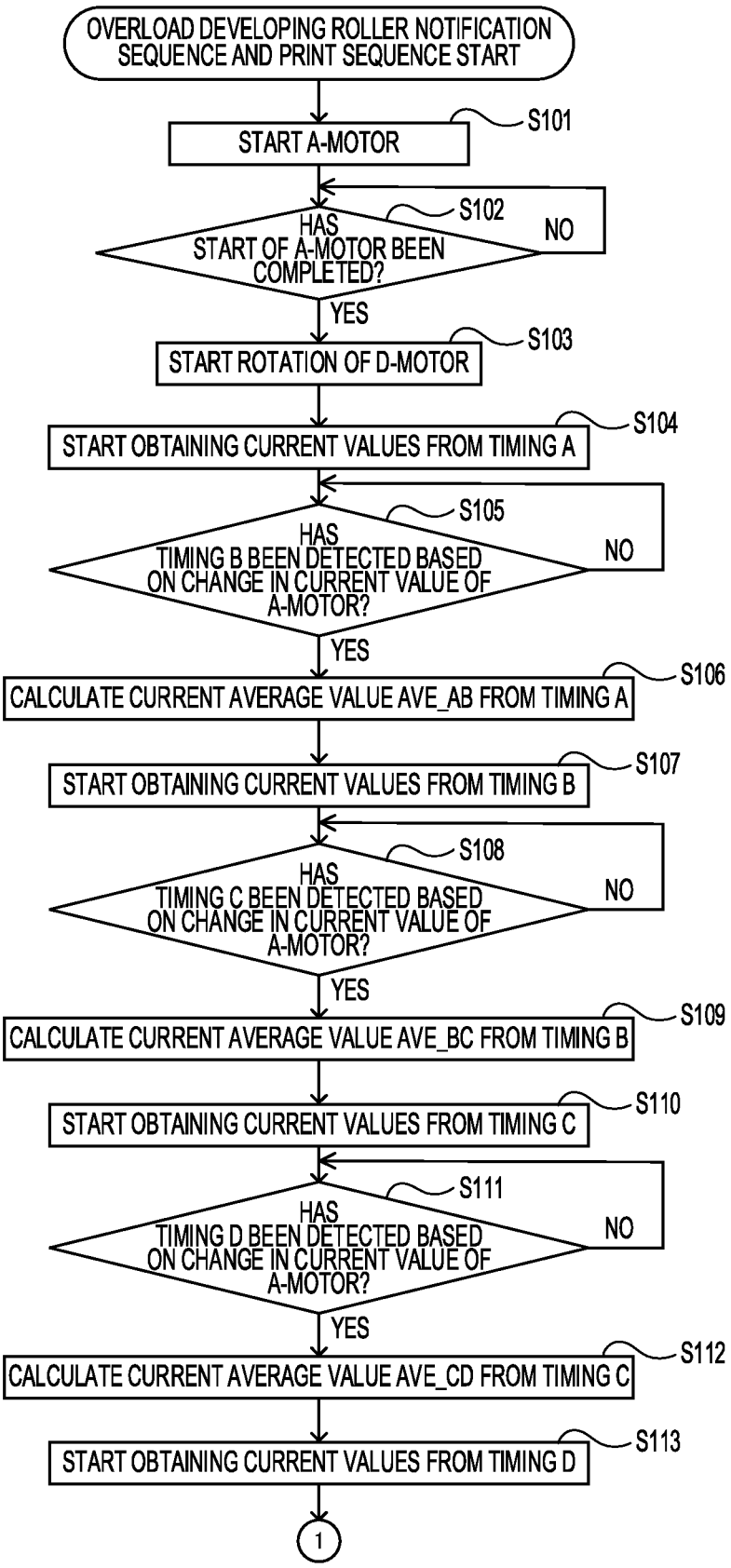
FIG. 8, which is comprised collectively of FIG. 8A, FIG. 8B and FIG. 8C, is a flowchart showing the control of the second embodiment.
Figure 8B:
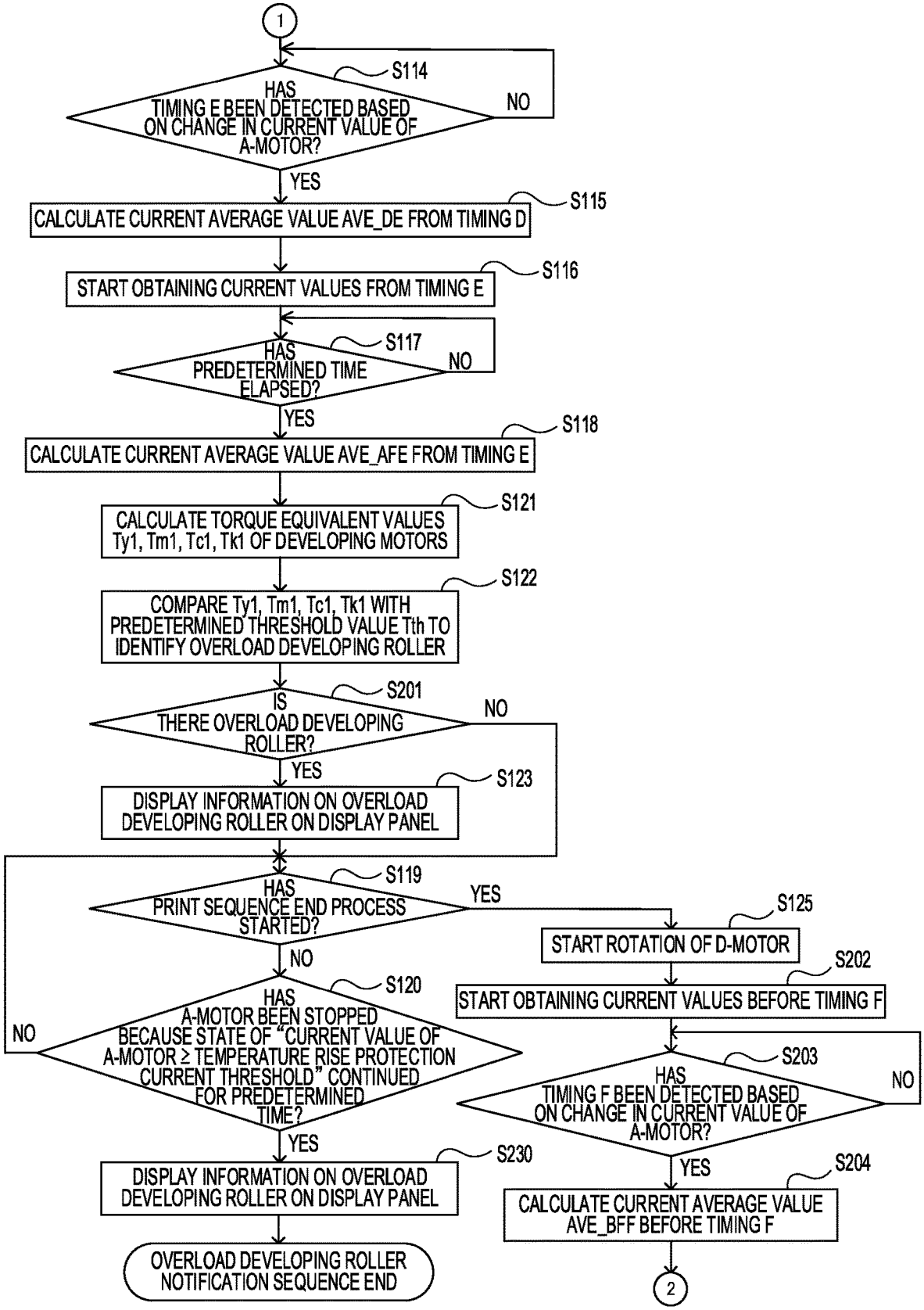
Figure 8C:
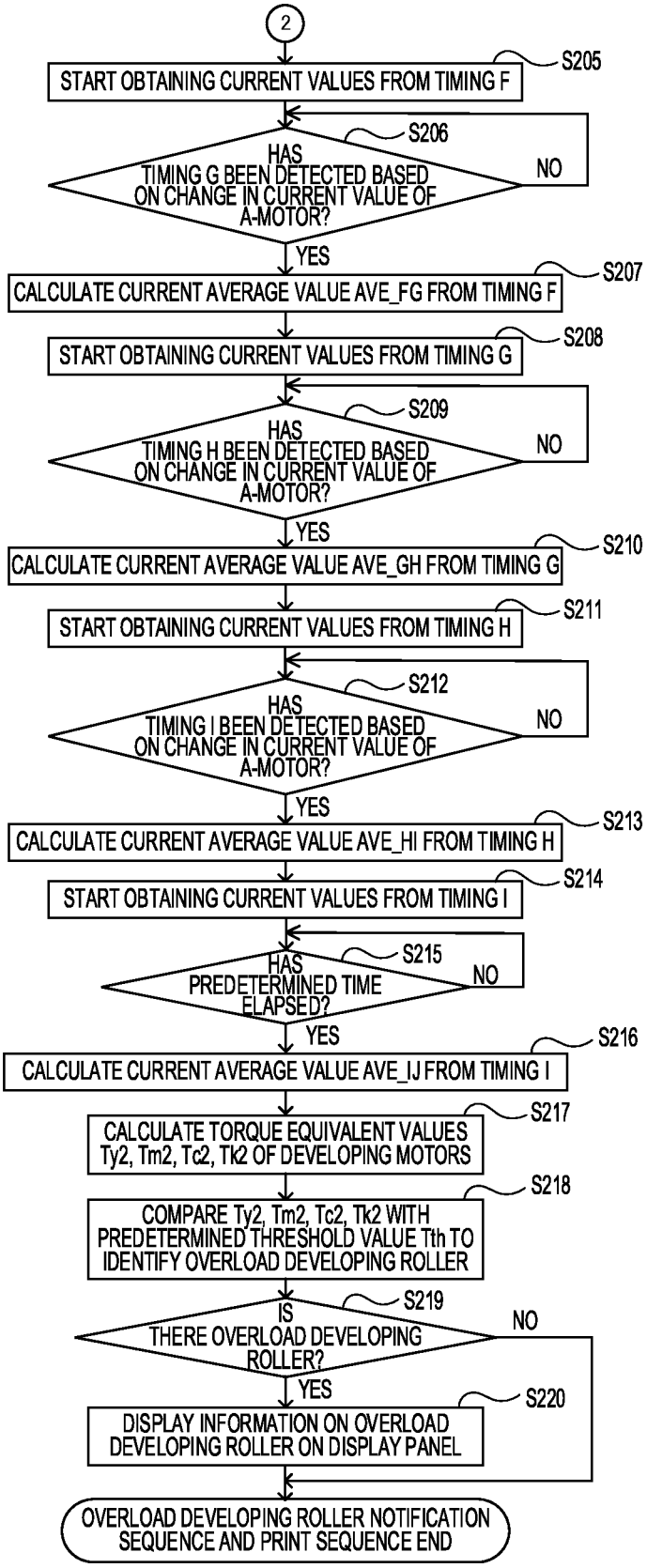

The control of the second embodiment will be described with reference to a flowchart of FIG. 8, which is composed collectively of FIG. 8A, FIG. 8B and FIG. 8C. Note that since the processes in S101 to S118 are the same order and processes as those described with reference to FIGS. 6A and 6B, description thereof will be omitted. In the second embodiment, in a case in which five current average values are calculated, the process proceeds to S121. In S121, the CPU 32 calculates the torque equivalent values Ty1, Tm1, Tc1, and Tk1 of the developing rollers 16Y, 16M, 16C, and 16K, respectively. In S122, the CPU 32 compares the torque equivalent values Ty1, Tm1, Tc1, and Tk1 calculated in S121 with the predetermined threshold value Tth, and identifies the developing roller of the station exceeding the predetermined threshold value Tth as the overload developing roller. If there is no overload developing roller, the information "none" is held. In S201, the CPU 32 determines whether or not there is the overload developing roller. In S201, if it is determined that there is the overload developing roller, the CPU 32 advances the process to S123, and if it is determined that there is no overload developing roller, the CPU 32 advances the process to S119. In S123, the CPU 32 displays information about the overload developing roller on the display panel 33 and/or the screen of the PC (not shown), and advances the process to S119.

In S119, the CPU 32 determines whether or not the print sequence end process has started. In S119, if it is determined that the print sequence end process has not started, the CPU 32 advances the process to S120, and if it is determined that the print sequence end process has started, the CPU 32 advances the process to S125. In S120, the CPU 32 determines whether or not the A-motor 101 has stopped due to the temperature rise protection. In S120, if it is determined that the A-motor 101 is not stopped, the CPU 32 returns the process to S119, and if it is determined that the A-motor 101 is stopped, the process proceeds to S230. In S230, the CPU 32 displays the information about the overload developing roller on the display panel 33. Note that the information displayed in S123 is the information about the overload developing roller identified before the A-motor 101 stops, and the information displayed in S230 is the information about the overload developing roller identified after the A-motor 101 stops. If the information displayed in S230 is the same as the information displayed in S123, the process in S230 may be omitted.

In S125, the CPU 32 starts the rotation of the D-motor 104. In S202, the CPU 32 starts to obtain the current value in order to obtain the current average value AVE_BFF of the A-motor 101 before the timing F. In S203, the CPU 32 monitors the current value of the A-motor 101 to determine whether the timing F is detected from the change in the current value. In S203, if it is determined that the timing F is not detected, the CPU 32 returns the process to S203, and if it is determined that the timing F is detected, the process proceeds to S204. In S204, the CPU 32 obtains the current average value AVE_BFF of the A-motor 101 until the timing F is detected.

In S205, the CPU 32 starts to obtain the current value in order to obtain the current average value AVE_FG of the A-motor 101 from the timing F. In S206, the CPU 32 monitors the current value of the A-motor 101 to determine whether the timing G is detected from the change in the current value. In S206, if it is determined that the timing G has not been detected, the CPU 32 returns the process to S206, and if it is determined that the timing G has been detected, the process proceeds to S207. In S207, the CPU 32 obtains the current average value AVE_FG of the A-motor 101 from the timing F.

In S208, the CPU 32 starts to obtain the current value in order to obtain the current average value AVE_GH of the A-motor 101 from the timing G. In S209, the CPU 32 monitors the current value of the A-motor 101 to determine whether the timing H has been detected from the change in the current value. In S209, if it is determined that the timing H has not been detected, the CPU 32 returns the process to S209, and if it is determined that the timing H has been detected, the process proceeds to S210. In S210, the CPU 32 determines the current average value AVE_GH of the A-motor 101 from the timing G.

In S211, the CPU 32 starts to obtain the current value in order to obtain the current average value AVE_HI of the A-motor 101 from the timing H. In S212, the CPU 32 monitors the current value of the A-motor 101 to determine whether the timing I is detected from the change in the current value. In S212, if it is determined that the timing I is not detected, the CPU 32 returns the process to S212, and if it is determined that the timing I is detected, the process proceeds to S213. In S213, the CPU 32 determines the current average value AVE_HI of the A-motor 101 from the timing H.

In S214, the CPU 32 completes the obtainment of the current value in order to obtain the current average value AVE_IJ of the A-motor 101 from the timing I. The CPU 32 resets and starts the timer 32*c*. In S215, the CPU 32 determines whether or not the predetermined time has elapsed by referring to the timer 32*c*. In S215, if it is determined that the predetermined time has not elapsed, the CPU 32 returns the process to S215, and if it is determined that the predetermined time has elapsed, the process proceeds to S216. In S216, the CPU 32 obtains the current average value AVE_IJ of the A-motor 101 until the predetermined time elapses from the timing I. In S217, the CPU 32 calculates the torque equivalent values Ty2, Tm2, Tc2, and Tk2 of the developing rollers 16. In S218, the CPU 32 compares the predetermined threshold value Tth with each torque equivalent value calculated in S217, and identifies the developing roller 16 at the station that has exceeded the predetermined threshold value Tth as the overload developing roller. The developing roller 16 identified as the overload developing roller is the overload developing roller that may cause the A-motor 101 to stop in the next print sequence, and the CPU 32 regards this as the sign.

In S219, the CPU 32 determines whether or not there is the overload developing roller. If it is determined in S219 that there is no overload developing roller, the CPU 32 ends the overload developing roller notification sequence and the print sequence. If it is determined in S219 that there is the overload developing roller, the CPU 32 advances the process to S220. In S220, the CPU 32 displays the information about the overload developing roller on the display panel 33 and/or the screen of the PC (not shown), and ends the overload developing roller notification sequence and the print sequence.

As described above, the information on the overload developing roller is notified to the user and the service person on the display panel 33 and/or the screen of the PC (not shown). Thus, the user and the service person can order a new developing roller in advance before the motor stops due to the abnormality of the developing roller.

In the first and second embodiments, the CPU 32 (printer controller 31) obtains the current average values and the torque equivalent values from the current values, but the motor controller 120 may obtain these values and transmit the obtained information to the CPU 32. That is, the functions of the printer controller 31 and the motor controller 120 are not limited to the embodiments described above. As described above, according to the second embodiment, the plurality of rollers can be driven by one motor. Further, even in the configuration in which the plurality of rollers are driven by the one motor, the torque values of respective rollers can be obtained.

[About Other Variations]

In the embodiment described above, the processing relating to the total load of the plurality of developing rollers 16 and the processing relating to the load of one developing roller 16 in the case in which the notification process is performed have been described. However, in the configurations of the first and second embodiments, it is possible to carry out the processing using the current values instead of the torque values in both cases of the plurality of developing rollers 16 and one developing roller 16. In the case of the plurality of developing rollers 16 and the case of one developing roller 16, the processing can be performed using the torque values. Further, one of the case of the plurality of developing rollers 16 and the case of one developing roller 16 can be processed using the current values and the other can be processed using the torque values.

As described above, in the case in which the current value is detected by the current detection portion while at least one or more developing rollers 16 are driven by the A-motor 101 and the current value is a first value, the information indicating that at least one or more developing rollers 16 are in the abnormal state is not displayed on the display panel 33. In the case in which the detected current value is a second value larger than the first value, the information indicating that at least one or more developing rollers 16 are in the abnormal state is displayed on the display panel 33.

Further, the following control can be performed. A first current value is detected by the current detection portion in a state in which the developing roller 16 of a predetermined color which is a first rotary member among at least one or more developing rollers 16 is not driven by the A-motor 101. A second current value is detected by the current detection portion while the developing roller 16 of the predetermined color is driven by the A-motor 101. In a case in which a difference between the first current value and the second current value is a first value, the control may be performed so that the information indicating that the developing roller 16 of the predetermined color is in the abnormal state is not displayed on the display panel 33. In a case in which the difference between the first current value and the second current value is a second value larger than the first value, the display panel 33 may be controlled to display the information indicating that the developing roller 16 of the predetermined color is in the abnormal state. The first value is smaller than the threshold value Tth, and the second value is larger than the first value and larger than the threshold value Tth. In these modifications as well, a plurality of rollers can be driven by one motor.

[Other Embodiments]

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-198380, filed Nov. 30, 2020, and Japanese Patent Application No. 2021-120719, filed Jul. 21, 2021 which are hereby incorporated by reference herein in their entirety.

What is claimed is:

1. An image forming apparatus, comprising:

at least one or more rotary members;

a motor configured to drive the at least one or more rotary members;

a detection unit configured to detect a current value flowing in the motor; and a display unit configured to display information about a state of the at least one or more rotary members, wherein the current value is detected by the detection unit in a state in which the at least one or more rotary members are being driven by the motor, and in a case in which the current value is a first value, information indicating that the at least one or more rotary members are in an abnormal state is not displayed on the display unit, and in a case in which the current value is a second value larger than the first value, information indicating that the at least one or more rotary members are in the abnormal state is displayed on the display unit.

2. The image forming apparatus according to claim 1, wherein a first current value is detected by the detection unit in a state in which a first rotary member among the at least one or more rotary members is not being driven by the motor, and a second current value is detected by the detection unit in a state in which the first rotary member is being driven by the motor, and in a case in which a difference between the first current value and the second current value is a third value, information indicating that the first rotary member is in an abnormal state is not displayed on the display unit, and in a case in which a difference between the first current value and the second current value is a fourth value larger than the third value, the information indicating that the first rotary member is in the abnormal state is displayed on the display unit.

3. The image forming apparatus according to claim 1, further comprising:

at least one or more transmission units provided corresponding to the at least one or more rotary members, respectively, and configured to transmit driving forces of the motor to the at least one or more rotary members, respectively; and a calculation unit configured to calculate respective torque values of the at least one or more rotary members based on the current value detected by the detection unit, wherein based on a difference between an average value of the current value detected by the detection unit in a case in which a transmission unit among the at least one or more transmission units is in a non-transmission state and an average value of the current value detected by the detection unit in a case in which the transmission unit is in a transmission state, the calculation unit calculates a torque value of a rotary member corresponding to the transmission unit.

4. The image forming apparatus according to claim 3, wherein each of the at least one or more rotary members is a developing roller, wherein the calculation unit calculates a torque value of the developing roller, and wherein the image forming apparatus further comprises a determination unit configured to compare the torque value of the developing roller calculated by the calculation unit with a predetermined first threshold value, and determine that the developing roller is overloaded in a case in which the torque value is larger than the first threshold value.

5. The image forming apparatus according to claim 4, wherein the determination unit causes the display unit to display information on the developing roller in a case in which the developing roller is overloaded.

6. The image forming apparatus according to claim 4, wherein the at least one or more rotary members are a plurality of developing rollers, wherein the at least one or more transmission units are a plurality of transmission units each corresponding to the plurality of developing rollers, respectively, and wherein the image forming apparatus further comprises a switching unit configured to switch the plurality of transmission units to the transmission state at different timings so that the plurality of developing rollers start rotating at the different timings, and switch the plurality of transmission units to the non-transmission state at different timings so that the plurality of developing rollers stop rotating at the different timings.

7. The image forming apparatus according to claim 3, wherein each of the at least one or more rotary members is a developing roller, wherein the calculation unit calculates a torque value of the developing roller, and wherein the image forming apparatus further comprises a determination unit configured to compare the torque value of the developing roller calculated by the calculation unit with a predetermined first threshold value, and determine whether or not the developing roller is overloaded based on a ratio of the torque value to the first threshold value.

8. The image forming apparatus according to claim 1, further comprising a control unit configured to control the motor, wherein the control unit stops the motor in a case in which a state in which the current value detected by the detection unit is larger than a threshold value continues for a predetermined time or more.

9. An image forming apparatus, comprising:

at least one or more rotary members;

a motor configured to drive the at least one or more rotary members;

a detection unit configured to detect a current value flowing in the motor; and a display unit configured to display information about a state of the at least one or more rotary members, wherein a first current value is detected by the detection unit in a state in which a first rotary member among the at least one or more rotary members is not being driven by the motor, and a second current value is detected by the detection unit in a state in which the first rotary member is being driven by the motor, and in a case in which a difference between the first current value and the second current value is a first value, information indicating that the first rotary member is in an abnormal state is not displayed on the display unit, and in a case in which the difference between the first current value and the second current value is a second value larger than the first value, the information indicating that the first rotary member is in the abnormal state is displayed on the display unit.

10. The image forming apparatus according to claim 9, further comprising:

at least one or more transmission units provided corresponding to the at least one or more rotary members, respectively, and configured to transmit driving forces of the motor to the at least one or more rotary members, respectively; and a calculation unit configured to calculate respective torque values of the at least one or more rotary members based on the current value detected by the detection unit;

wherein based on a difference between an average value of the current value detected by the detection unit in a case in which a transmission unit among the at least one or more transmission units is in a non-transmission state and an average value of the current value detected by the detection unit in a case in which the transmission unit is in a transmission state, the calculation unit calculates a torque value of a rotary member corresponding to the transmission unit.

11. An image forming apparatus, comprising:

at least one or more rotary members;

a motor configured to drive the at least one or more rotary members;

a control unit configured to control the motor;

at least one or more transmission units provided corresponding to the at least one or more rotary members, respectively, and configured to transmit driving forces of the motor to the at least one or more rotary members, respectively;

a switching unit configured to switch between a transmission state in which a transmission unit among the at least one or more transmission units transmits a driving force of the motor to a corresponding rotary member and a non-transmission state in which the driving force of the motor is not transmitted to the rotary member;

a detection unit configured to detect a current value flowing in the motor; and a calculation unit that calculates a torque value of each of the at least one or more rotary members based on the current value detected by the detection unit, wherein the calculation unit calculates a torque value of the rotary member corresponding to the transmission unit based on a current value detected by the detection unit when the transmission unit is in the non-transmission state and a current value detected by the detection unit when the transmission unit is in the transmission state.

12. The image forming apparatus according to claim 11, wherein the calculation unit calculates the torque value of the rotary member corresponding to the transmission unit based on a difference between an average value of the current value detected by the detection unit when the transmission unit is in the non-transmission state and an average value of the current value detected by the detection unit when the transmission unit is in the transmission state.

13. The image forming apparatus according to claim 11, wherein the rotary member is a developing roller, wherein the calculation unit calculates the torque value of the developing roller, and wherein the image forming apparatus further comprises a determination unit configured to compare the torque value of the developing roller calculated by the calculation unit with a predetermined first threshold value, and determine that the developing roller is overloaded in a case in which the torque value is larger than the first threshold value.

14. The image forming apparatus according to claim 13, further comprising a display unit configured to display information on a state of the at least one or more rotary members, wherein the determination unit causes the display unit to display information on the developing roller in a case in which the developing roller is overloaded.

15. The image forming apparatus according to claim 13, wherein the at least one or more rotary members are a plurality of developing rollers, wherein the at least one or more transmission units are a plurality of transmission units corresponding to the plurality of developing rollers, respectively, and wherein the switching unit switches the plurality of transmission units to the transmission state at different timings so that the plurality of developing rollers start rotating at the different timings, and switches the plurality of transmission units to the non-transmission state at different timings so that the plurality of developing rollers stop rotating at the different timings.

16. The image forming apparatus according to claim 15, wherein the control unit stops the motor in a case in which a state in which the current value detected by the detection unit is larger than a second threshold value continues for a predetermined time or more.

17. The image forming apparatus according to claim 16, wherein the motor is a brushless motor.

18. The image forming apparatus according to claim 17, wherein the brushless motor comprises a stator core, a stator having a coil wound around the stator core, and a rotor including a permanent magnet, and wherein the control unit includes a switching element configured to flow a current to the coil and an output unit configured to output a pulse for controlling on/off of the switching element.

19. The image forming apparatus according to claim 11, wherein the rotary member is a developing roller, wherein the calculation unit calculates the torque value of the developing roller, and wherein the image forming apparatus further comprises a determination unit configured to compare the torque value of the developing roller calculated by the calculation unit with a predetermined first threshold value, and determine whether or not the developing roller is overloaded based on a ratio of the torque value to the first threshold value.

* * * * *